US011663997B2

(12) United States Patent
Kebrle

(10) Patent No.: US 11,663,997 B2
(45) Date of Patent: May 30, 2023

(54) MUSICAL INSTRUMENT LOCKING NUT ASSEMBLY THAT ATTACHES TO A TRUSS ROD OR A TRUSS ROD EXTENSION

(71) Applicant: John Michael Kebrle, Dallas, TX (US)

(72) Inventor: John Michael Kebrle, Dallas, TX (US)

( * ) Notice: Subject to any disclaimer, the term of this patent is extended or adjusted under 35 U.S.C. 154(b) by 76 days.

(21) Appl. No.: 17/249,405

(22) Filed: Mar. 1, 2021

(65) Prior Publication Data

US 2021/0272538 A1 Sep. 2, 2021

Related U.S. Application Data

(60) Provisional application No. 62/983,735, filed on Mar. 1, 2020.

(51) Int. Cl.

| | |
|---|---|
| ***G10D 3/12*** | (2020.01) |
| ***G10D 1/08*** | (2006.01) |
| ***G10D 3/153*** | (2020.01) |
| ***G10D 3/04*** | (2020.01) |

(52) U.S. Cl.

CPC ..... *G10D 3/12* (2013.01); *G10D 1/08* (2013.01); *G10D 3/04* (2013.01); *G10D 3/153* (2020.02)

(58) Field of Classification Search

CPC .. G10D 3/12; G10D 1/08; G10D 3/04; G10D 3/153

See application file for complete search history.

(56) References Cited

U.S. PATENT DOCUMENTS

| | | | | |
|---|---|---|---|---|
| 3,241,418 | A | | 3/1966 | Fender |
| 3,248,991 | A | | 5/1966 | Cole |
| 3,326,072 | A | | 6/1967 | Price |
| 3,396,284 | A | | 8/1968 | Scherer |
| 3,407,696 | A | | 10/1968 | Smith et al. |
| 3,990,341 | A | | 11/1976 | Pace |
| 4,135,426 | A | | 1/1979 | Rickard |
| 4,141,271 | A | | 2/1979 | Mullen |
| 4,171,661 | A | | 10/1979 | Rose |
| 4,285,262 | A | | 8/1981 | Scholz |
| 4,354,417 | A | | 10/1982 | Glaser |
| 4,361,068 | A | | 11/1982 | Schaller |
| 4,457,201 | A | | 7/1984 | Storey |
| 4,497,236 | A | | 2/1985 | Rose |
| 4,516,462 | A | | 5/1985 | Schulze |
| 4,517,874 | A | * | 5/1985 | Fender ..... G10D 3/12 84/214 |
| 4,549,461 | A | | 10/1985 | Rose |
| 4,555,970 | A | | 12/1985 | Rose |
| 4,563,934 | A | | 1/1986 | Keizer |
| 4,632,004 | A | | 12/1986 | Steinberger |
| 4,674,389 | A | | 6/1987 | Fender |
| 4,882,967 | A | | 11/1989 | Rose |

(Continued)

OTHER PUBLICATIONS

Notice of Allowance, dated Oct. 4, 2021, by the USTPO, re U.S. Appl. No. 17/249,402.

*Primary Examiner* — Kimberly R Lockett

(74) *Attorney, Agent, or Firm* — Law Office of Bill Naifeh

(57) ABSTRACT

Disclosed is a locking nut assembly that includes a baseplate mounted on the head of a musical instrument, such as a guitar. The baseplate includes channels configured to receive strings of the musical instrument and at least one locking plate to secure the strings in the channels. A bracket couples a truss rod positioned in a neck of the musical instrument to the baseplate.

12 Claims, 14 Drawing Sheets

(56) References Cited

U.S. PATENT DOCUMENTS

| | | | | |
|---|---|---|---|---|
| 4,915,006 | A | 4/1990 | Steinberger | |
| 4,955,275 | A | 9/1990 | Gunn | |
| 4,967,631 | A | 11/1990 | Rose | |
| 4,993,300 | A | 2/1991 | Ejen | |
| 5,046,393 | A | 9/1991 | Xenidis | |
| 5,497,690 | A | 3/1996 | Soupios | |
| 5,637,818 | A | 6/1997 | Fishman et al. | |
| 5,864,074 | A | 1/1999 | Hill | |
| 7,459,619 | B2 | 12/2008 | Gawenda | |
| 9,959,845 | B2 * | 5/2018 | Decker | G10D 3/12 |
| 2008/0229900 | A1 | 9/2008 | Steinberger | |

* cited by examiner

MUSICAL INSTRUMENT LOCKING NUT ASSEMBLY THAT ATTACHES TO A TRUSS ROD OR A TRUSS ROD EXTENSION

CLAIM OF PRIORITY AND INCORPORATION BY REFERENCE

This application claims the benefit of U.S. Provisional Application Ser. No. 62/983,735, filed on Mar. 1, 2020, and entitled A TORSIONAL BASED TREMOLO SYSTEM AND APPARATUS FOR INCREASING OR DECREASING THE TENSION AND PITCH OF THE STRINGS OF A MUSICAL INSTRUMENT, which is hereby incorporated by reference in its entirety.

TECHNICAL FIELD

The invention relates in general to musical instruments and in particular to a locking nut assembly that extends a truss rod's stabilization into the instrument's head and provides secure string clamping.

BRIEF DESCRIPTION OF THE DRAWINGS

For a more complete understanding, reference is now made to the following description taken in conjunction with the accompanying Drawings in which.

DETAILED DESCRIPTION

Figure 1A:
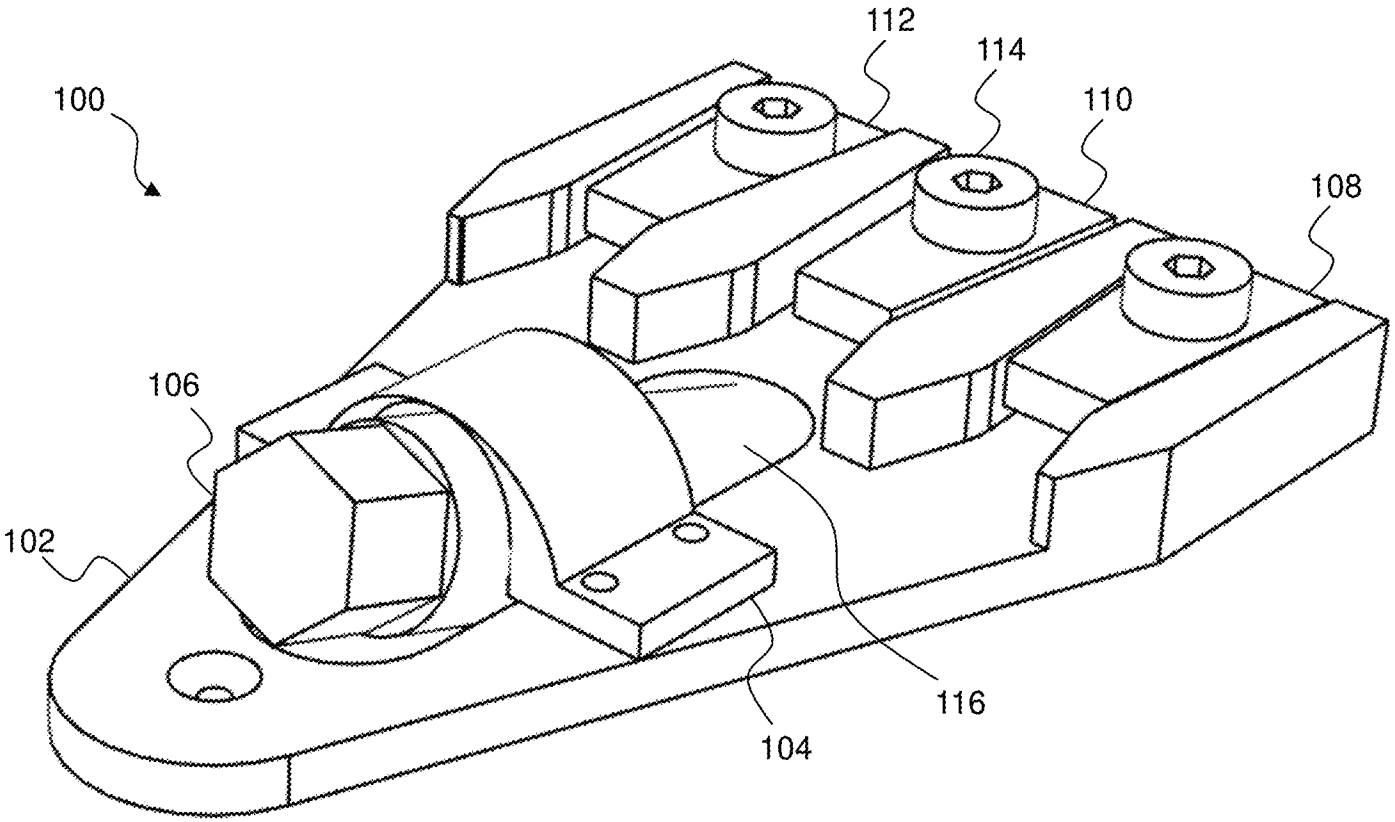
FIGS. 1A-1F illustrate various views of one embodiment of a locking nut assembly.

Specific examples of components and component arrangements are described below to simplify the present disclosure. These are, of course, merely examples and are not intended to limit the invention from that described in the claims. Well-known elements may be presented without detailed description in order not to obscure the present invention in unnecessary detail. For the most part, details unnecessary to obtain a complete understanding of the present invention have been omitted inasmuch as such details are within the skills of persons of ordinary skill in the relevant art.

When directions, such as upper, lower, top, bottom, clockwise, counterclockwise, are discussed in this disclosure, such directions are meant to only supply reference directions for the illustrated figures and for orientation of components in the figures unless specifically stated otherwise. The directions should not be read to imply actual directions used in any resulting invention or actual use. Under no circumstances should such directions be read to limit or impart any meaning into the claims.

Referring to FIGS. 1A-1F, one embodiment of a locking nut assembly (aka, a string clamping assembly) 100 is illustrated. The locking nut assembly 100 is configured to be attachable to a string musical instrument without requiring permanent, irreversible modifications to the instrument. It is understood, however, that in other embodiments modifications may be made to the musical instrument prior to mounting the locking nut assembly 100.

For purposes of example, the locking nut assembly 100 is described with respect to its use with a guitar and the figures generally illustrate the locking nut assembly as configured to interact with six separate strings of the instrument. However, for other numbers of strings, additional components may be added or removed, or some illustrated components may remain unused if not needed.

The strings of a musical instrument, such as a guitar, place tension on the instrument's neck by pulling the head towards the body. This tension operates to create a curvature in neck that is often called up-bow or forward bow. While a certain minimal amount of forward bow may be acceptable or even desired, excessive forward bow can result high action, string buzz, and/or other problems. In some cases, guitars may experience back bow where the neck bends in the opposite direction.

Truss rods are used to provide stabilization within the neck of a stringed instrument, such as a guitar. Truss rods may be non-adjustable or adjustable. Adjustable truss rods may be single action, which adjust only in one direction to move the neck in the back bow direction (and so reduce the amount of forward bow), or dual action, which can be used to offset back bow as well as forward bow.

Adjustable truss rods can be configured to adjust at the head end of the guitar or the heel. Generally, a nut or screw mechanism is tightened or loosened, which in turn bends the truss rod. Accordingly, by tightening or loosening the nut or screw, the truss rod can be bent or straightened to compensate for forward bow or back bow in the neck, thereby flattening or substantially flattening the neck and/or fretboard as desired.

The locking nut assembly 100 of FIG. 1A may couple to a truss rod at the head end by replacing the truss rod's nut. By attaching directly to the truss rod, rather than having separate mounting screws, the locking nut assembly 100 may be installed and removed without permanent modifications to the guitar. In addition, by coupling directly to the truss rod or an extension, the stiffness of the truss rod can be extended into the head area of the instrument, and the truss rod can be adjusted in a normal manner with the nut replacement.

Referring specifically to FIG. 1A, the locking nut assembly 100 includes a baseplate 102 with an upper bracket 104 that may be coupled thereto. Locking plates 108, 110, and 122 may be coupled to the baseplate 102 using fasteners 114, such as screws. A truss nut 106 is coupled to or forms part of a rod 116.

Figure 1B:
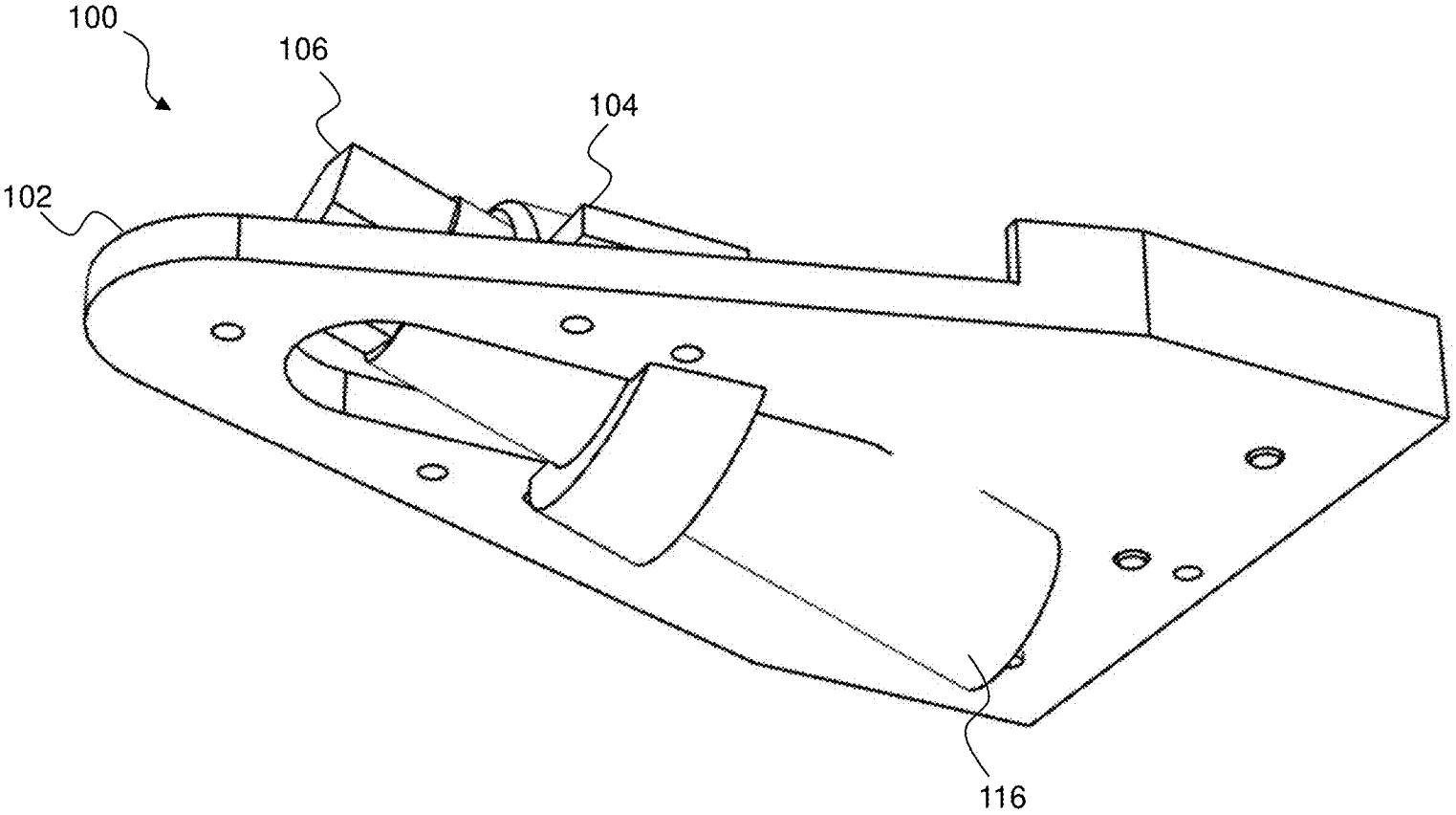
Figure 1C:
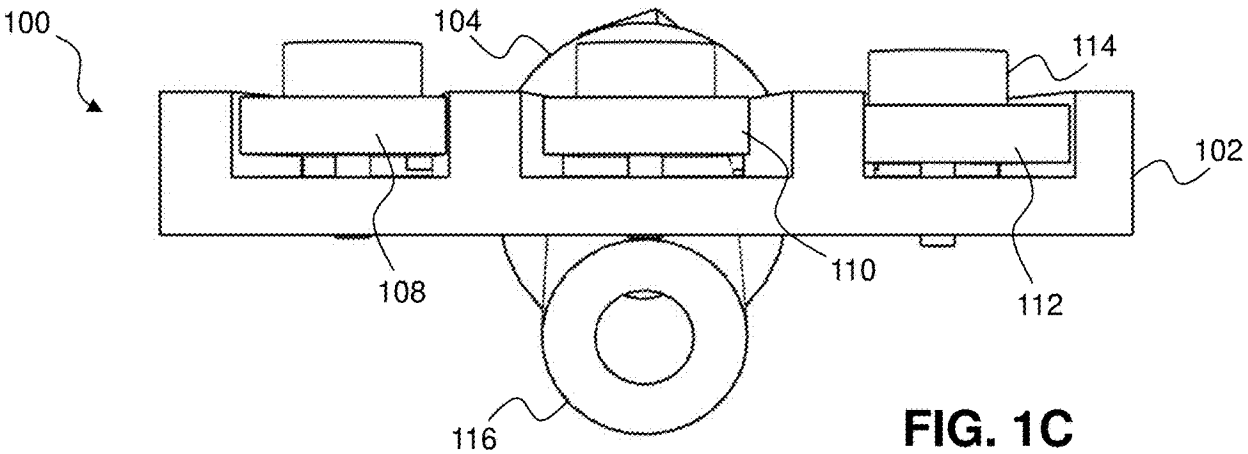
Figure 1D:
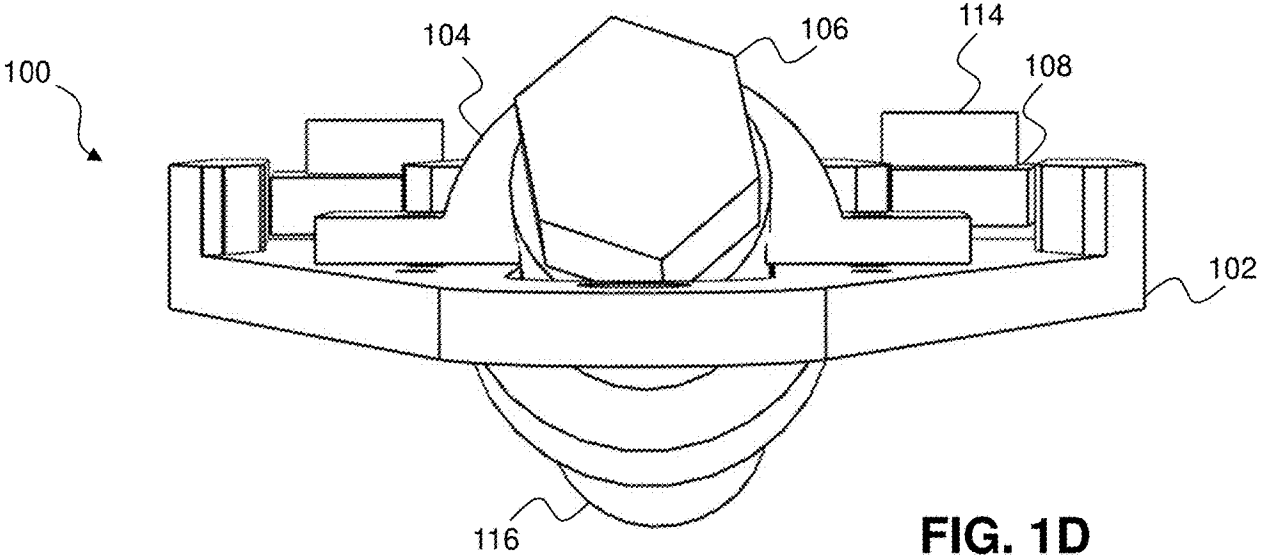
Figure 1E:
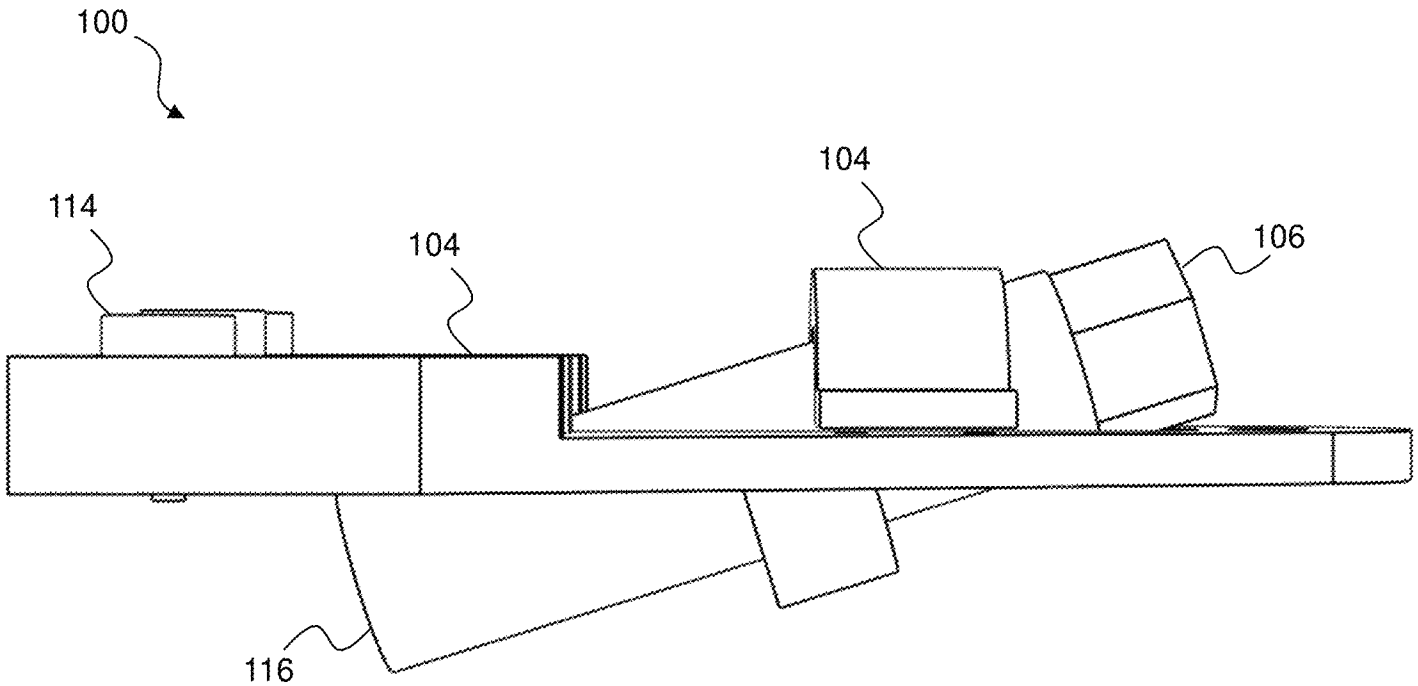
Figure 1F:
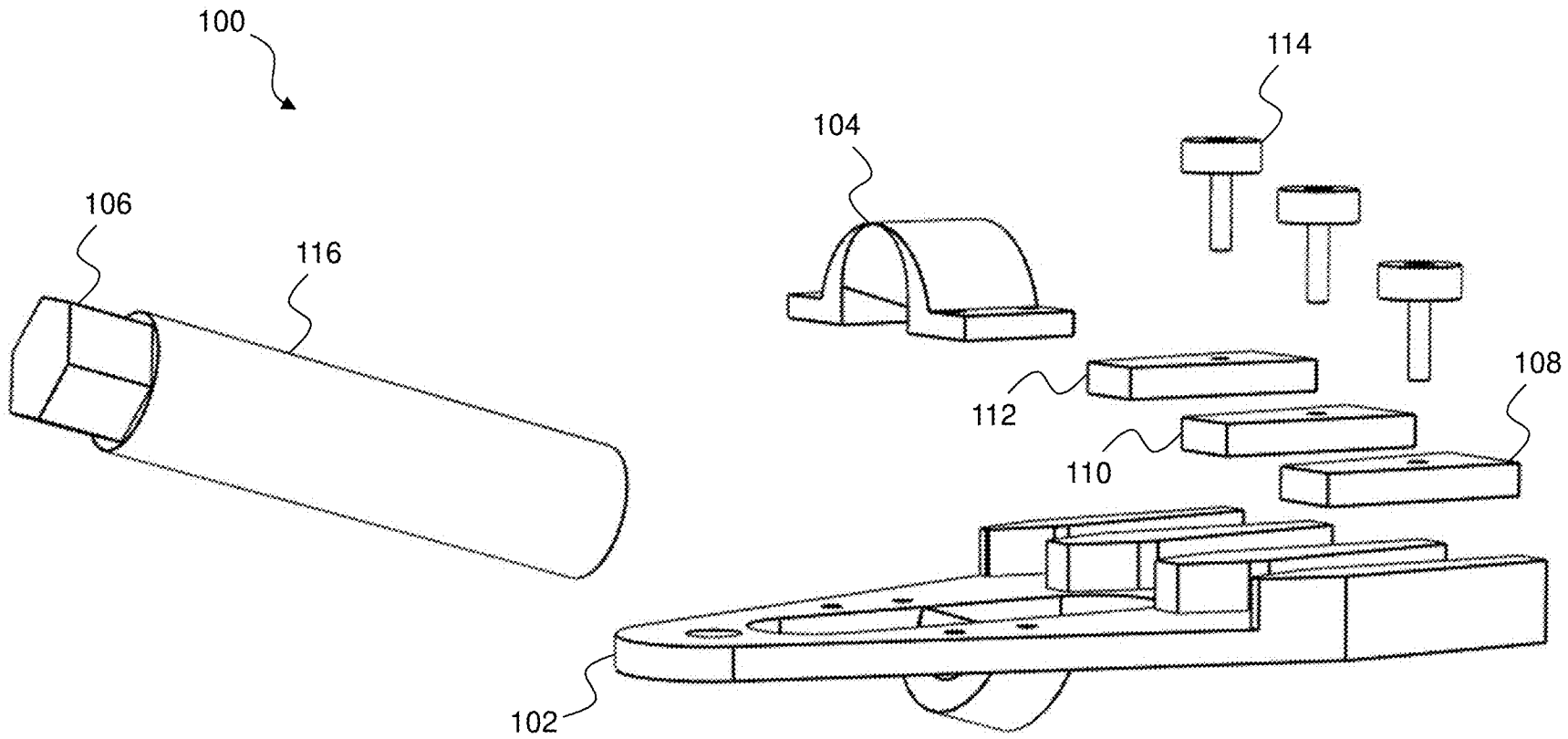
Figure 2A:
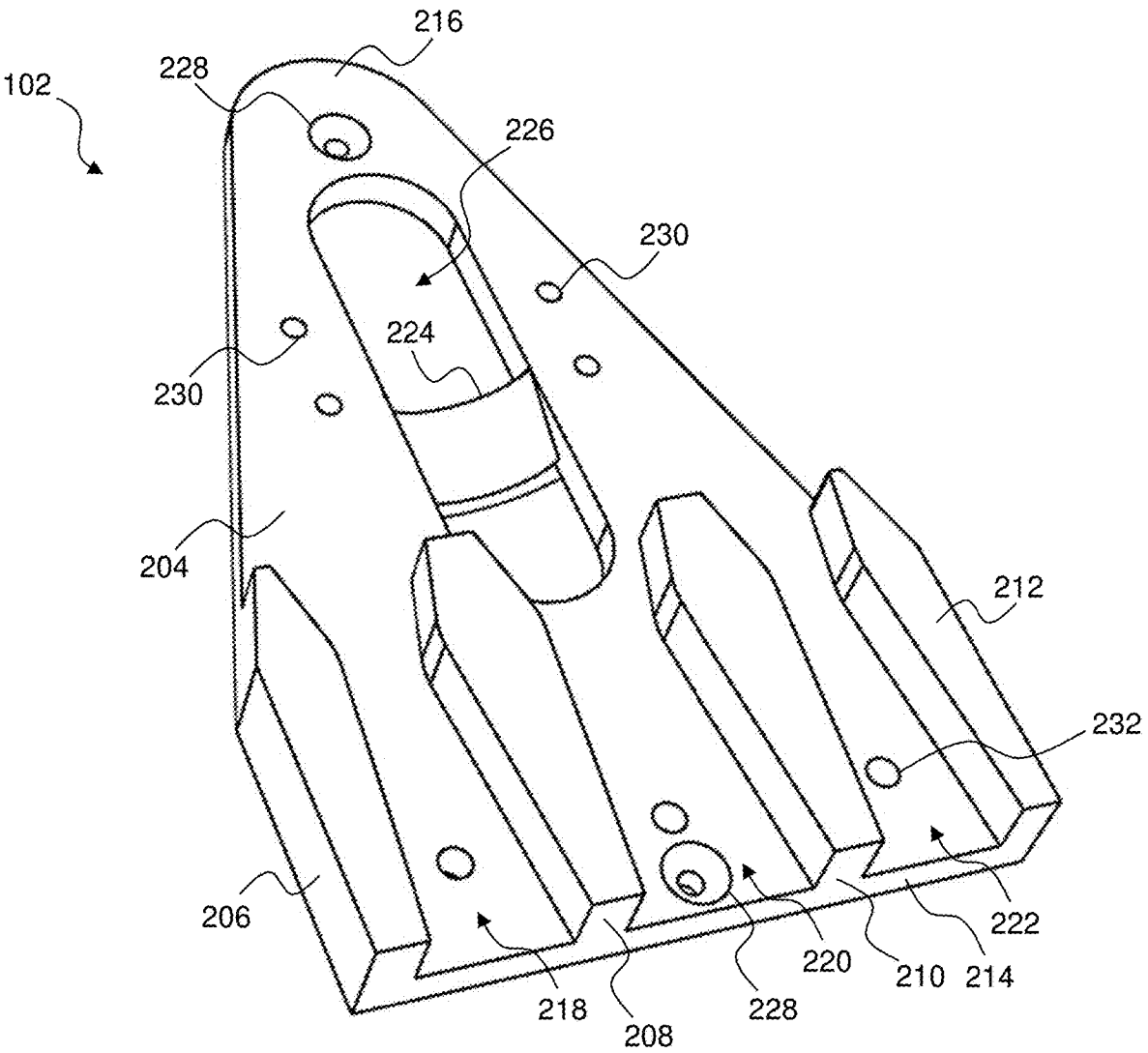
FIGS. 2A-2G illustrate one embodiment of a baseplate of the locking nut assembly of FIG. 1A.
Figure 2B:
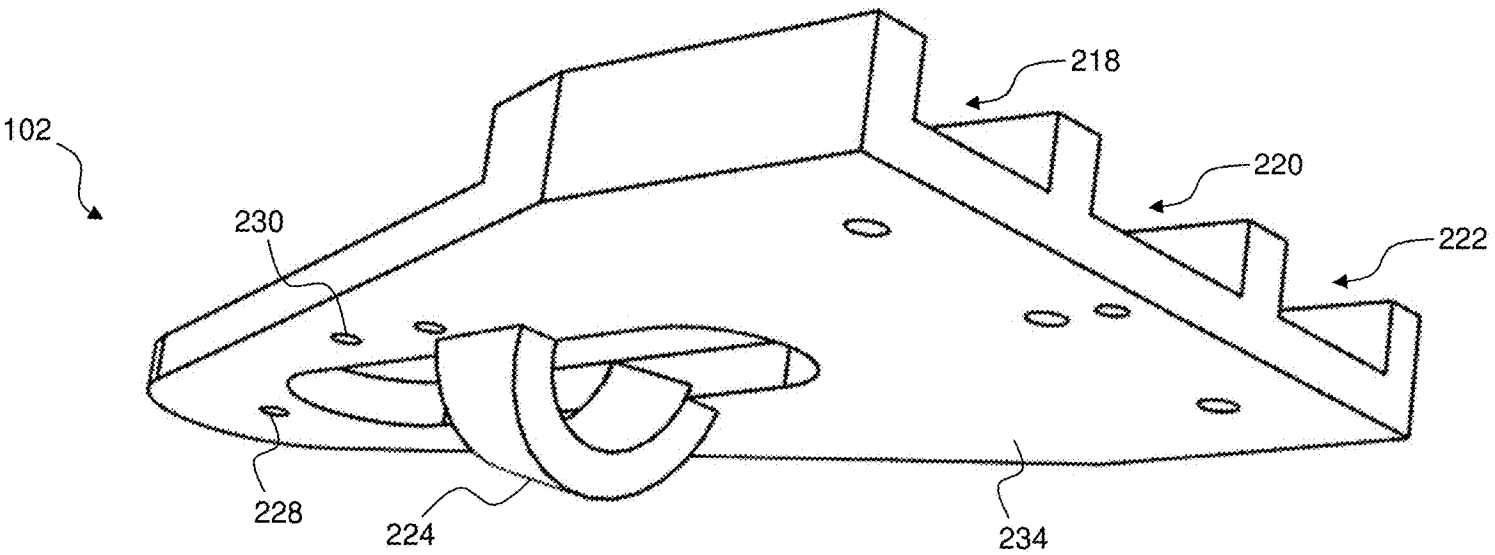
Figure 2C:
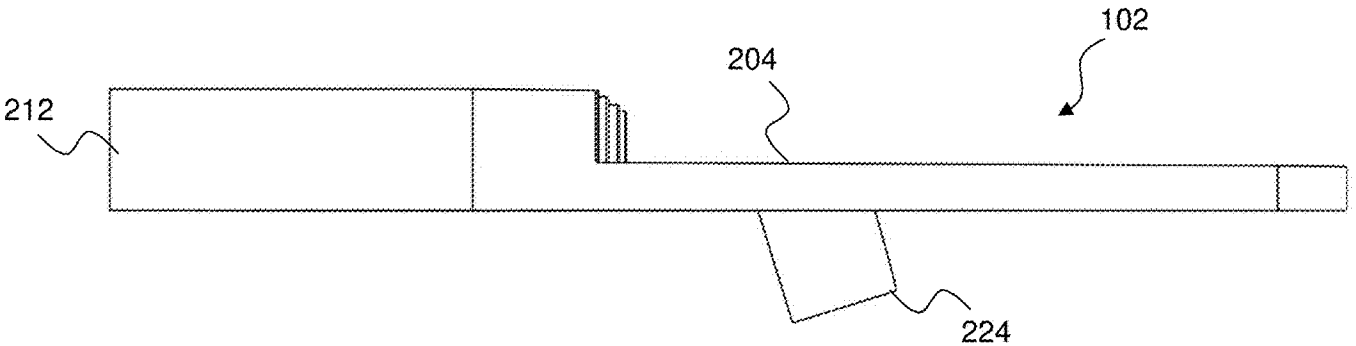
Figure 2E:
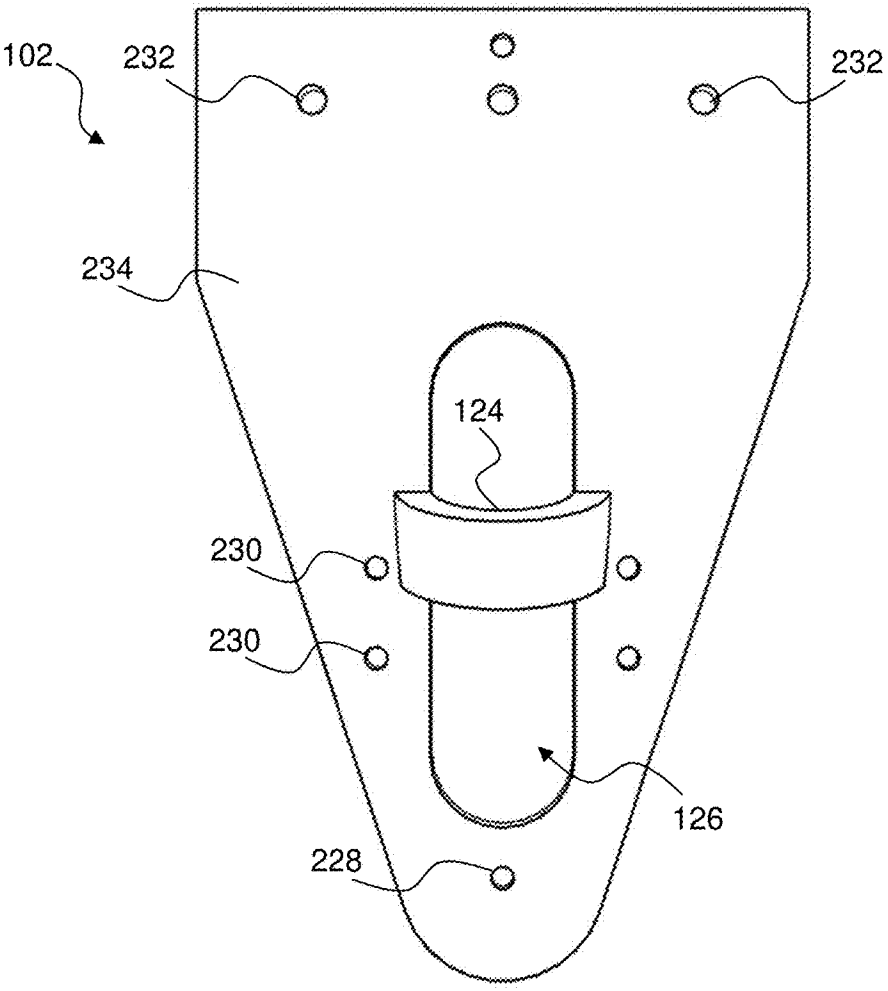
Figure 2D:
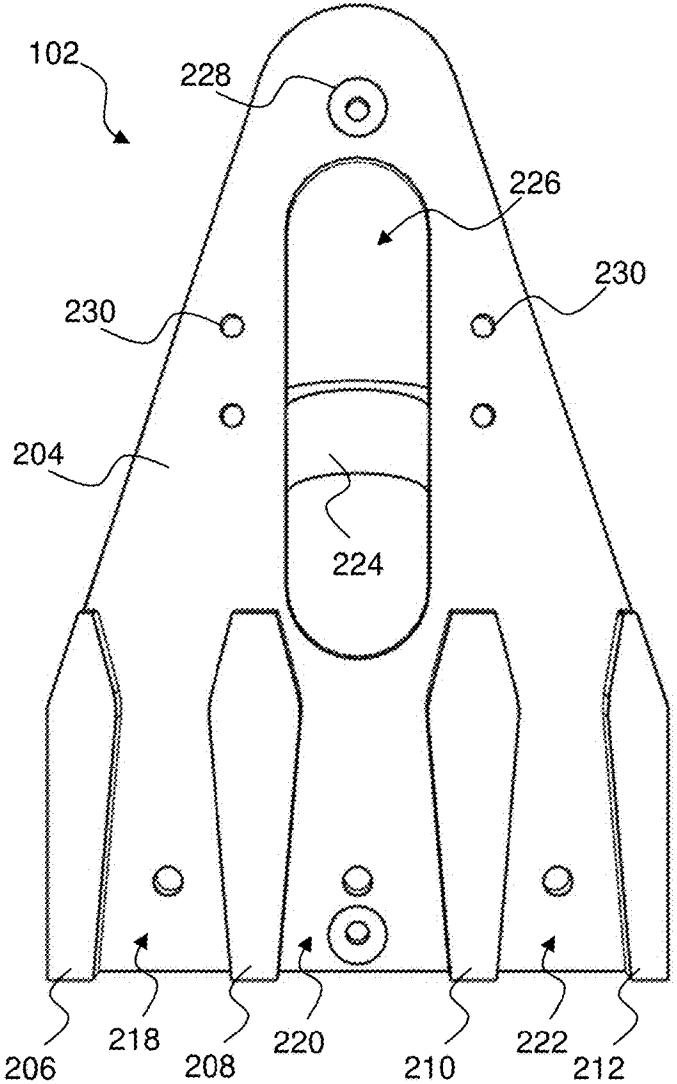
Figure 2F:
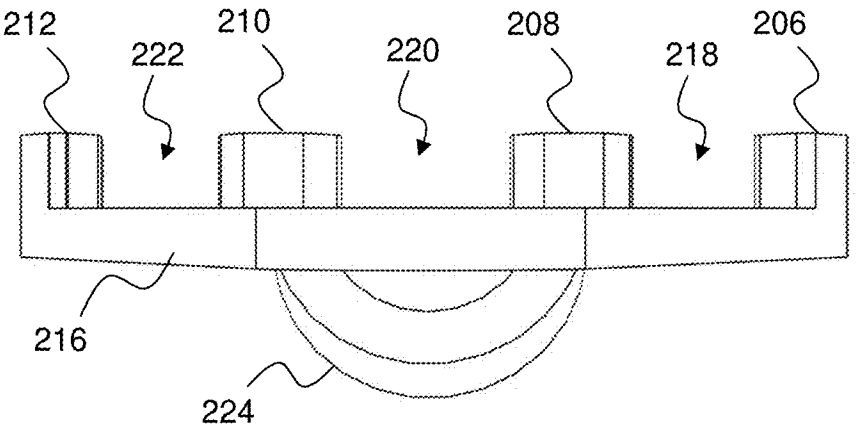
Figure 2G:
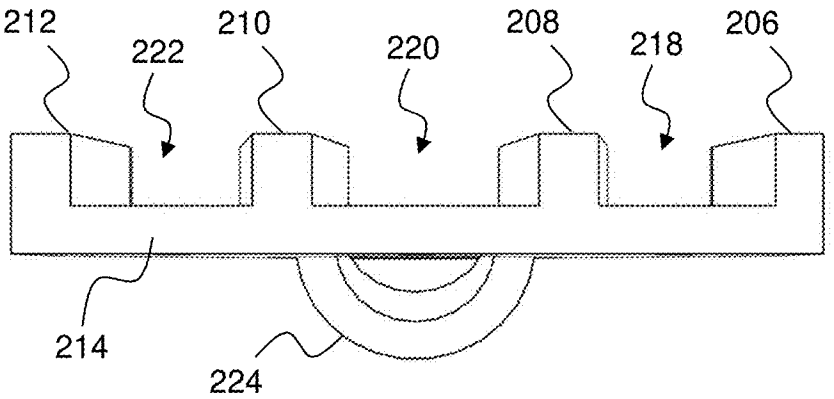

With additional reference to FIG. 1F and generally to FIGS. 1B-1E, the locking nut assembly 100 is shown in an exploded view with the baseplate 102 and upper bracket 104. The truss nut 106 is shown with a rod 116, which may be an extension that couples to a truss rod. Accordingly, the end of the rod 116 may include an appropriate head with which to engage the truss rod's adjustment mechanism, whether the mechanism is a nut or a screw type adjustment. For example, if the truss rod is adjusted using a threaded nut, the nut may be replaced by the rod with a threaded end and then adjusted with the nut replacement. In other embodiments, the end of the rod 116 may engage the nut of the truss rod, rather than replace it. The truss rod adjustment mechanism may then be manipulated by turning the truss nut 106, which in turn rotates the rod 116 and the coupled truss rod adjustment mechanism.

In other embodiments, the rod 116 may be a portion of a truss rod (and therefore not part of the locking nut assembly 100) or may be a sleeve. For example, the rod 116 may be a hollow sleeve that fits over the truss rod in order to ensure a tighter fit between the locking nut assembly 100 and the truss rod. If a sleeve, the nut 106 may be proportioned differently to engage the truss rod, rather than the sleeve.

Different rods 116 may be used with the locking nut assembly 100 based on the particular truss rod adjustment mechanism with which the locking nut assembly 100 is to be used. This allows for use of the locking nut assembly 100 with different types of truss rods by selection of the appropriate rod 116.

Referring to FIGS. 2A-2G, one embodiment of the baseplate 102 of FIGS. 1A and 1B is illustrated. In the present example, the baseplate 102 includes a substantially planar upper surface 204 from which four sections 206, 208, 210, and 212 extend vertically. The sections 206, 208, 210, and 212 run from a lower end 214 of the baseplate 100 towards an upper end 216 and are therefore roughly parallel to the strings' alignment down the instrument's neck. The sections 206, 208, 210, and 212 are substantially parallel and form three channels 218, 220, and 222. As the current example is described with respect to a six string guitar, each channel 218, 220, and 222 would receive two strings when mounted on the guitar. The channels 218, 220, and 222 may serve as guides to enable improved clamping of the strings, regardless of string gauge or size.

The walls of the channels 218, 220, and 222 may be angled or sloped to aid in directing the strings towards the middle. In the present example, the angles produce an interior width that is narrower than the width at either end, but it is understood that many different channel shapes may be used with the locking nut assembly 100. For example, a channel partition may be used anywhere within a channel to divide the channel into multiple channels either in part or along the entire length of the channel. In some embodiments, the walls and/or floors of the channels 208, 210, and 212 may be grooved. Although shown with different shapes, it is understood that the shape of any particular channel may vary from other channels, or all channels may have an identical shape. It is noted that by making the channels narrower, the strings may make better contact with the baseplate 102 and not slip to the side.

The locking plates 108, 110, and 112 (FIG. 1A) are used to secure the strings in the channels 218, 220, and 222. It is understood that the number of channels may be increased or decreased, with one or more strings in a channel based on the particular channel configuration. Furthermore, the locking plates 108, 110, and 112 may be combined into a single locking plate, two locking plates, or more locking plates (e.g., a locking plate per string). Although shown with different shapes, it is understood that the shape of a locking plate may vary based on the shape of the channel with which the locking plate is to be used. Accordingly, if all channels have the same shape, then all locking plates may also have the same shape.

A lower bracket 224 mounted on a lower surface 234 is configured to support the lower part of a truss rod (not shown), which may be accessible through the baseplate 102 via an opening 226. The lower bracket 224, which may be permanently coupled to the baseplate 102 or may be removable, may have an interior surface angled in the direction of the truss rod's longitudinal axis. This enables the truss rod to fit securely within the lower bracket 224. In some embodiments in which the lower bracket 224 is removable, the dimensions (e.g., angle of slope and/or width) of the lower bracket 224 may be selected based on the diameter of the truss rod with which the locking nut assembly 100 is to be used. In other embodiments in which the lower bracket 224 is not removable, a locking nut assembly 100 with the appropriately sized lower bracket 224 may be selected. In still other embodiments, full or partial rings (not shown) may be used with the lower bracket 224 to ensure a secure fit.

One or more mounting holes 228 may be used to mount the clamping assembly 100 to the head of the guitar. Other threaded openings 230 may be used to secure the upper bracket 114 (FIG. 1A) to the baseplate 102. Threaded openings 232 may be used to secure fasteners for the locking plates 108, 110, and 112.

It is understood that the location and number of mounting holes may vary depending on the particular instrument onto which the locking nut assembly 100 is to be mounted. In other embodiments, the baseplate 102 may be provided as multiple plates that are individually mounted to the musical instrument. In addition, it is understood that various spacers or other features may be integrated into or otherwise used with the baseplate 102.

It is understood that the screws described herein may be replaced by any other suitable fastener, and may be in various forms (e.g., thumbscrews intended for manipulation via fingers and/or various screwhead configurations intended for manipulation via tools). Furthermore, it is understood that some openings may be replaced by a threaded screw or a similar mechanism that is to be engaged by a nut or another fastener.

Figure 3B:
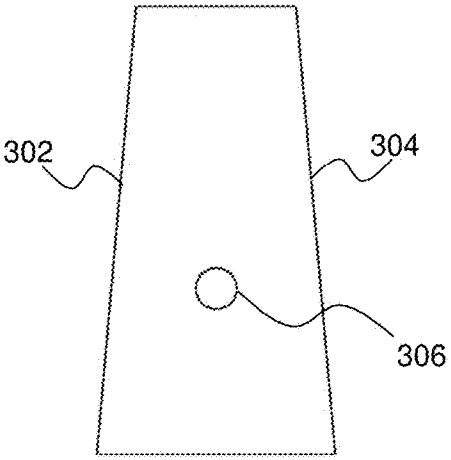
FIGS. 3A-4B illustrate embodiments of locking plates of the locking nut assembly of FIG. 1A.
Figure 3A:
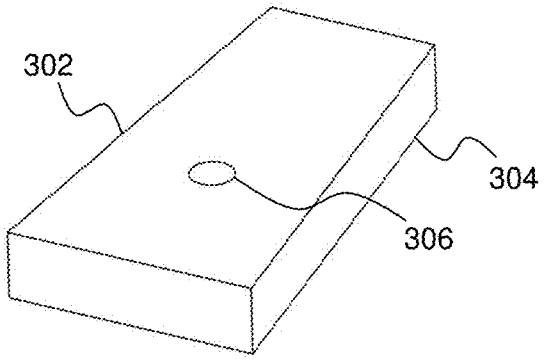

Referring to FIGS. 3A and 3B, one embodiment of the side channel locking plates 108 and 112 of FIG. 1A is illustrated. As shown, the side channel locking plates 108 and 112 may have angled sides 302 and 304 that are angled to fit within the channels 218 and 222 or the portion of the channel with which they are to be used. An opening 310, which may be threaded, may be provided to receive a fastener to secure the side channel locking plates 108 and 112 to the baseplate 102 using openings 232.

Figure 4B:
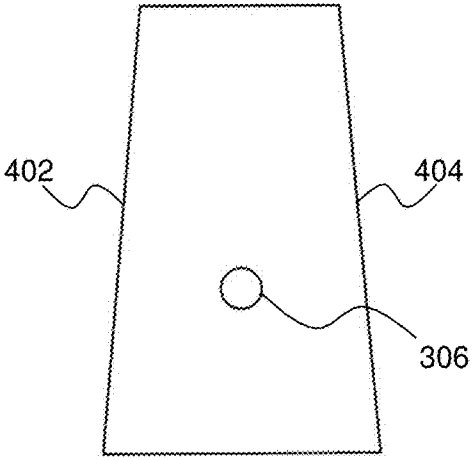
Figure 4A:
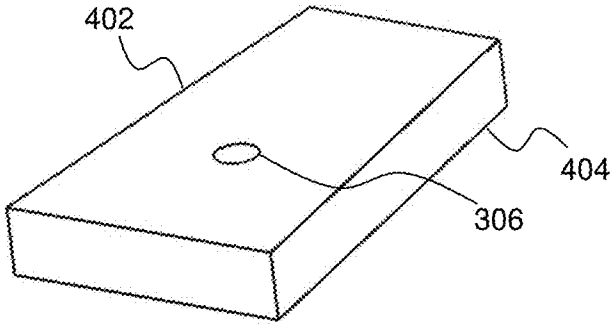

Referring to FIGS. 4A and 4B, one embodiment of the center locking plate 110 of FIG. 1A is illustrated. As shown, the center channel locking plate 110 may have angled sides 402 and 404 that are angled to fit within the channel 220 or the portion of the channel with which it is to be used. An opening 406, which may be threaded, may be provided to receive a fastener to secure the center channel locking plate 110 to the baseplate 102 using opening 232.

Figure 5B:
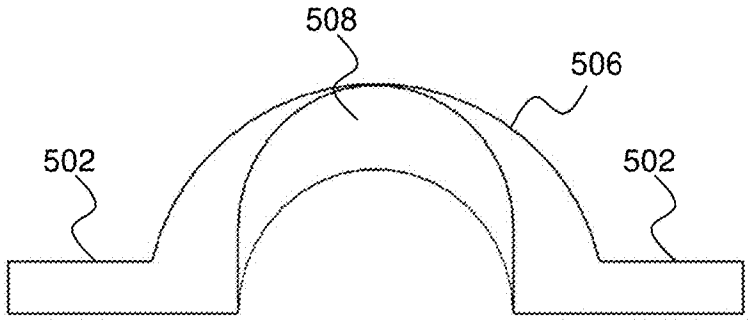
FIGS. 5A-5C illustrate one embodiment of a bracket of the locking nut assembly of FIG. 1A.
Figure 5A:
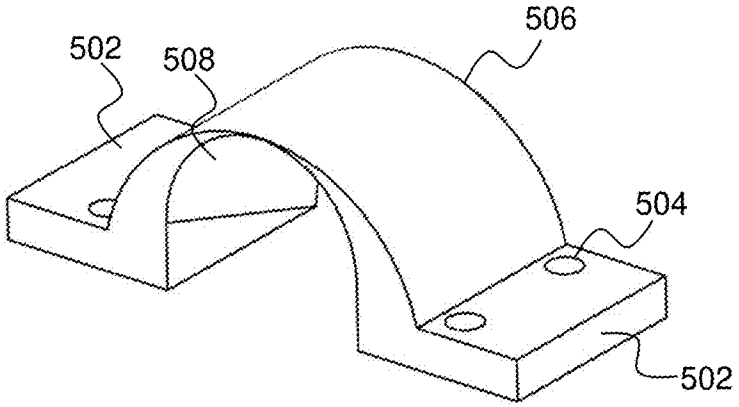
Figure 5C:
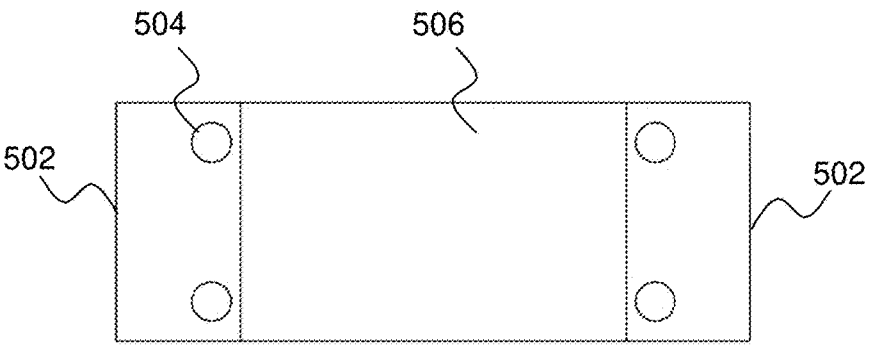

Referring to FIGS. 5A-5C, one embodiment of the upper bracket 104 of FIG. 1A is illustrated. The upper bracket 104 may include flanges 502 having openings 504 therein to secure the upper bracket to the baseplate 102 via openings 230. An arched portion 506 of the upper bracket 104 between the flanges 502 may be shaped to receive the rod 116 or a truss rod. The arched portion 506 may include a sloped surface 508 angled to substantially match an angle of the rod 116.

Figure 6:
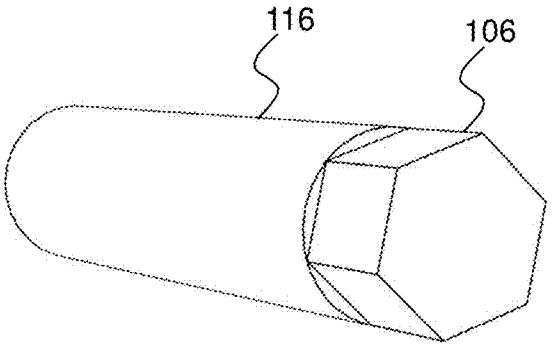
FIG. 6 illustrates one embodiment of a truss rod extension of the locking nut assembly of FIG. 1A.

Referring to FIG. 6, one embodiment of the truss nut 106 and rod 116 of FIG. 1A is illustrated.

Figure 7B:
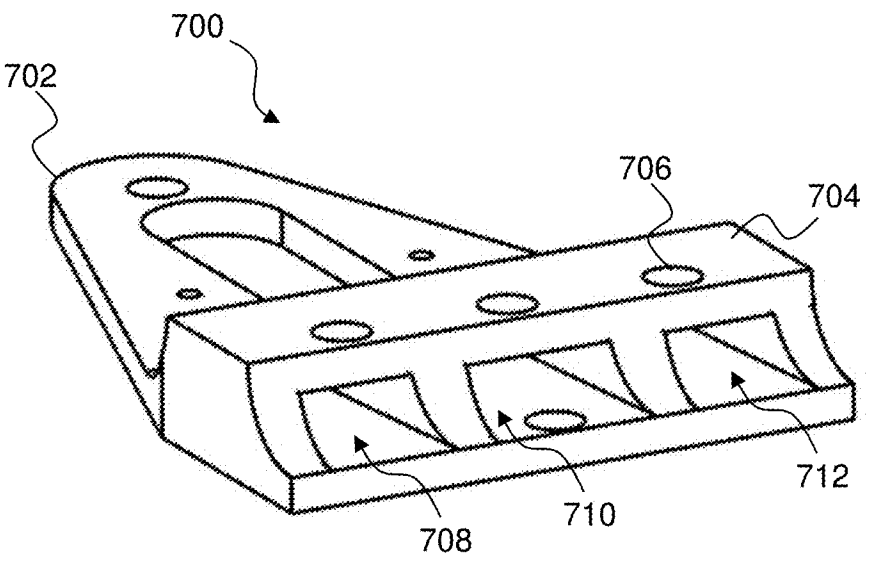
FIGS. 7A and 7B illustrate another embodiment of a locking nut assembly.
Figure 7A:
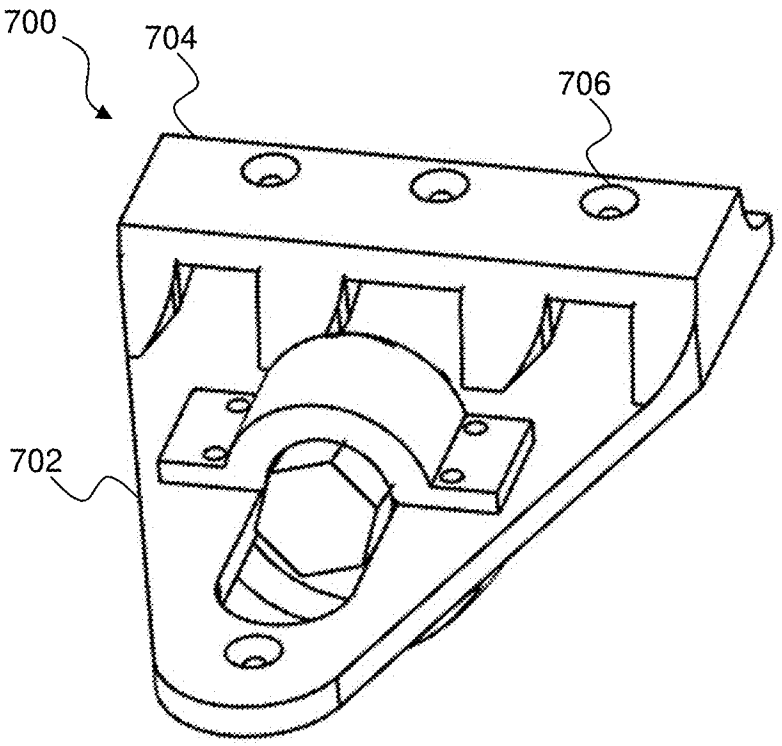

Referring to FIGS. 7A and 7B, an alternate embodiment of a locking nut assembly 700 is illustrated. The locking nut assembly 700 is similar to the locking nut assembly 100 of FIG. 1A except for the channel design. In the present example, the baseplate 702 includes a plate 704 that overlays channels 708, 710, and 712. The plate 704 may be part of the baseplate 702 or may be removable. Openings 706, which may be threaded, may be used to insert fasteners (e.g., screws) into the channels 708, 710, and 712 to secure the strings. In some embodiments, locking plates (not shown) may be positioned within the channels 708, 710, and 712 to press down the strings when the screws are tightened. Although not described in detail herein, the other components of the locking nut assembly 700 may be similar or identical to those of the locking nut assembly 100 of FIG. 1A, including variations and modifications as described above.

Figure 8A:
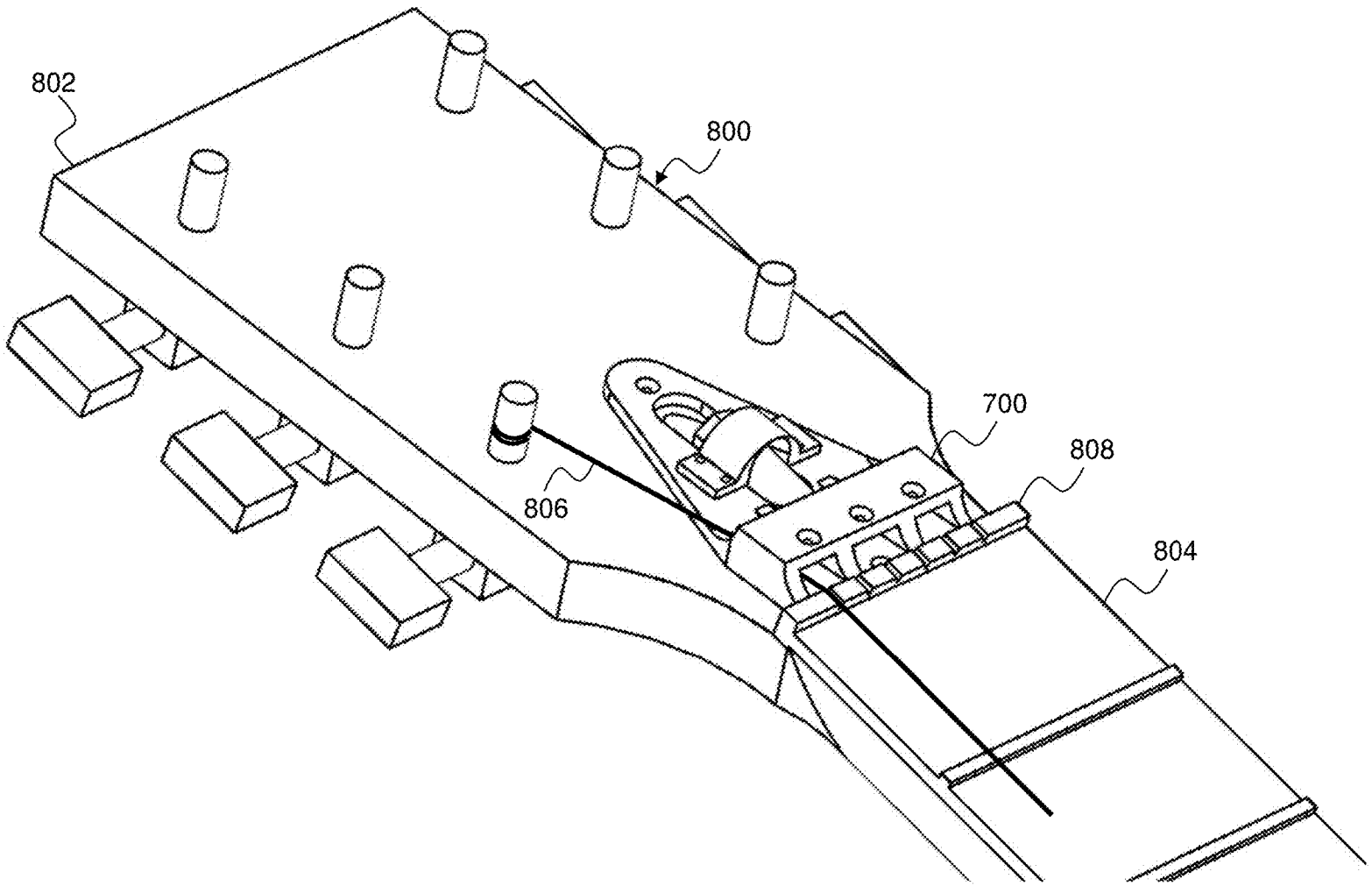
FIGS. 8A and 8B illustrate the locking nut assembly of FIG. 7A mounted on a guitar.
Figure 8B:
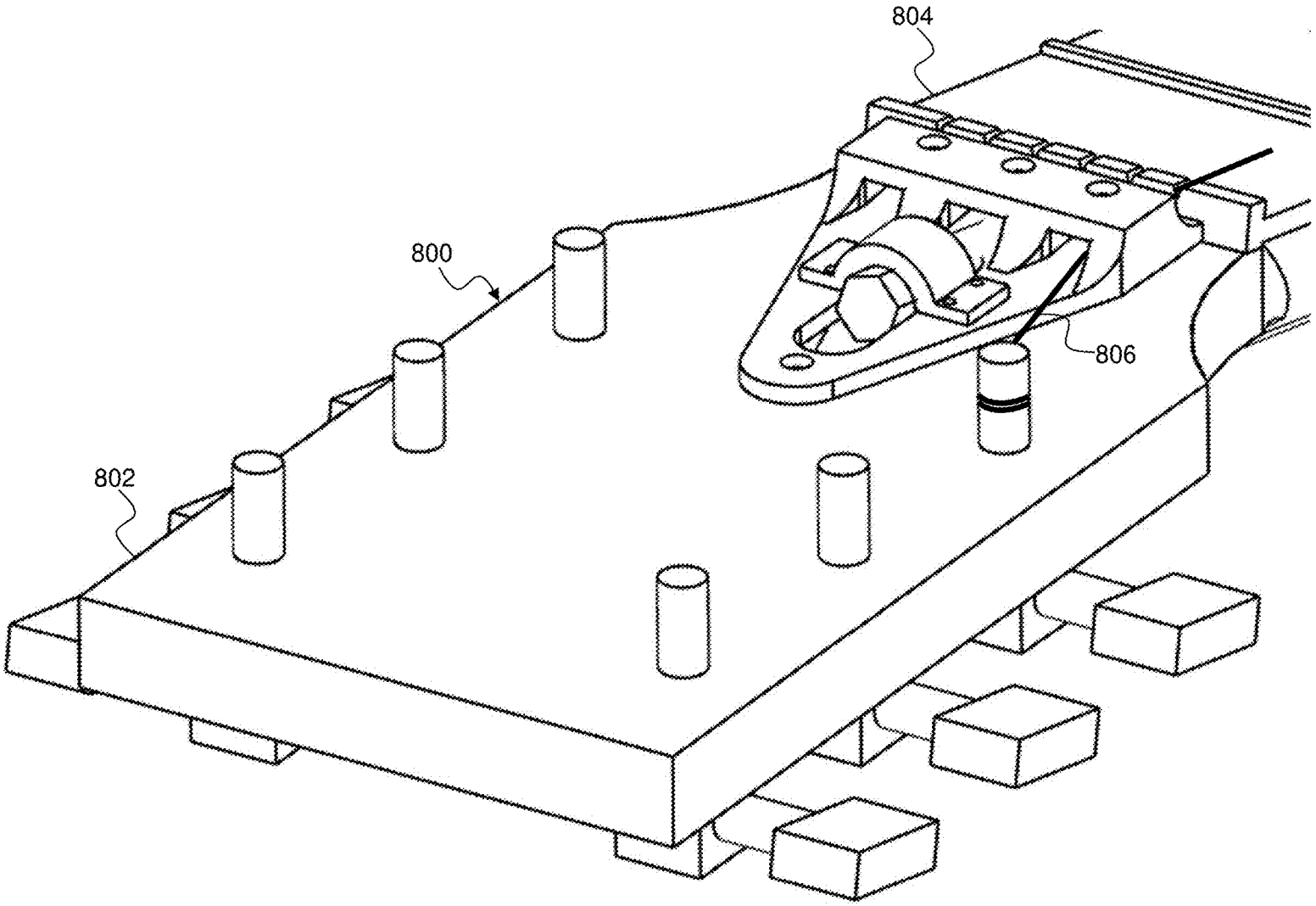

Referring to FIGS. 8A and 8B, one embodiment of the locking nut assembly 700 is illustrated as mounted on a guitar 800 relative to the guitar's head 802 and neck 804. A string 806 is illustrated for purposes of example as positioned with respect to a locking nut 808 and the locking nut assembly 700.

Any advantages and benefits described may not apply to all embodiments of the invention. When the word "means" is recited in a claim element, Applicant intends for the claim element to fall under 35 USC 112(f). Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC 112(f).

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

What is claimed is:

1. A locking nut assembly for a string musical instrument comprising:

a baseplate mounted on a head of the musical instrument and including a plurality of channels configured to receive strings of the musical instrument, wherein at least one channel includes an interior wall having an angled surface;

at least one locking plate to secure the strings in the channels;

a bracket configured to couple a truss rod positioned in a neck of the musical instrument to the baseplate, and an extension configured to engage a threaded end of the truss rod, wherein the bracket is positioned to provide room for the extension to be manipulated without removing the bracket.

2. The locking nut assembly of claim 1 wherein the angled surface creates an interior channel width that is narrower than a channel width at each end of the channel.

3. The locking nut assembly of claim 2 wherein a bottom surface of at least one channel is flat.

4. The locking nut assembly of claim 2 wherein a bottom surface of at least one channel contains a groove.

5. The locking nut assembly of claim 1 wherein the at least one locking plate includes a separate locking plate for a left channel, a center channel, and a right channel.

6. The locking nut assembly of claim 1 wherein a first portion of the bracket is immovably coupled to the baseplate and a second portion of the bracket is removable.

7. The locking nut assembly of claim 1 wherein at least a portion of an internal surface of the bracket is sloped at an angle to match an angle of the truss rod relative to the head.

8. A locking nut assembly for a string musical instrument comprising:

a baseplate mounted on a head of the musical instrument and including a channel for at least one string of the musical instrument;

a locking plate to secure the string in the channel;

a bracket for coupling a truss rod to the baseplate, wherein the truss rod is positioned in a neck of the musical instrument, and an extension configured to engage a threaded end of the truss rod, wherein the bracket is positioned to provide room for the extension to be manipulated without removing the bracket.

9. The locking nut assembly of claim 8 wherein at least one side of the channel includes an angled surface.

10. The locking nut assembly of claim 9 wherein the angled surface of the channel creates an interior channel width that is narrower than a channel width at each end of the channel.

11. The locking nut assembly of claim 8 wherein a first portion of the bracket is immovably coupled to the baseplate and a second portion of the bracket is removable.

12. The locking nut assembly of claim 8 wherein at least a portion of an internal surface of the bracket is sloped at an angle to match an angle of the truss rod relative to the head.

* * * * *